United States Patent [19]

Goldstein

[11] 4,444,418

[45] Apr. 24, 1984

[54] PORTABLE CARRYING CASE WITH REMOVABLE FOLIO ASSEMBLY

[76] Inventor: Stanley Goldstein, P.O. Box 29376, Dallas, Tex. 75229

[21] Appl. No.: 375,718

[22] Filed: May 7, 1982

[51] Int. Cl.[3] ..... B42F 13/00

[52] U.S. Cl. ..... 281/45; 190/16; 190/901; 402/75

[58] Field of Search ..... 281/45, 46, 48, 17, 281/19 R, 19 A; 402/8, 19, 21, 75, 80 R; 190/16; 150/1.6; 24/204

[56] References Cited

U.S. PATENT DOCUMENTS

| | | | |
|---|---|---|---|
| 2,365,607 | 12/1944 | Thomsen | 281/19 A |
| 3,151,886 | 10/1964 | Grant et al. | 281/19 R |
| 3,322,129 | 5/1967 | Drysdale | 281/17 |
| 3,469,333 | 9/1969 | Roberts | 281/45 X |
| 3,617,074 | 11/1971 | Rigolini | 281/49 X |
| 3,659,703 | 5/1972 | Oliver | 150/1.6 X |
| 3,752,503 | 8/1973 | Holes et al. | 24/204 X |
| 3,833,098 | 9/1974 | Alderman | 248/460 X |
| 4,129,212 | 12/1978 | Hopkins | 402/77 X |
| 4,239,411 | 12/1980 | Moliard | 402/77 |

*Primary Examiner*—Paul A. Bell
*Assistant Examiner*—John S. Brown
*Attorney, Agent, or Firm*—Kenneth R. Glaser

[57] ABSTRACT

A carrying case comprising opposed cover members hinged to a central spine portion. The cover members are adapted to be secured together by a slide fastener to form a closed case or laid open to allow viewing of one or more pages of a folio arrangement supported by a frame member which is secured within the case on the spine portion by self-adhering fastener means of the Velcro type. The folio assembly includes an elongated flat metal or plastic frame member which is adapted to support one or more elongated elastic folio support rods for pivotally supporting the folio pages to be turned in the manner of turning pages of a book. The support rods may be elastically deflected to insert separate folio pages in or remove separate folio pages from the folio assembly frame or the entire folio assembly may be quickly inserted in and removed from the case, as desired.

5 Claims, 3 Drawing Figures

PORTABLE CARRYING CASE WITH REMOVABLE FOLIO ASSEMBLY

BACKGROUND OF THE INVENTION

1. Field of the Invention

The present invention pertains to a carrying case having a pair of opposed cover portions hinged to a central spine portion which is provided with a quick release retainer for supporting a folio assembly which may be interchanged in whole or in part with other folio assemblies.

2. Background Art

There are many applications for carrying cases, sometimes referred to generally as briefcases or attache cases, wherein it is desirable to be able to support a plurality of folios, flexible leaves or pages within the case and adapted such that, when the case is opened, the pages or foilos may be turned for viewing each one individually. As a practical matter, most easily carriable cases are designed to accommodate only a relatively limited number of folio pages and, accordingly, it is often necessary to interchange the material in the case with alternate materials or samples. For example, a commercial artist, model or sales representative may wish to have one folio illustrating samples and/or photographs representing a particular specialty when calling on a particular client and then be able to interchange the folio assembly with a second or alternate folio assembly when calling on a client interested in material of a different subject matter. Understandably, it is time consuming and inconvenient to remove material from one set of folios or jackets and replace it with material of a different subject matter. Accordingly, there has been a need to provide a carrying case having a folio assembly which may be interchanged easily and rapidly with a separate folio assembly so that the carrying case itself may be used for various purposes and for carrying various sets of materials.

SUMMARY OF THE INVENTION

The present invention provides an improved carrying case of a type for carrying substantially flat materials representing, for example, samples of artwork or other illustrations, photographs, or material samples, which materials are mounted on a frame which may be secured within the case and may be quickly interchanged with another folio assembly including a frame and an alternate set of folios.

In accordance with an important aspect of the present invention, there is provided a carrying case having an elongated spine portion to which is integrally hinged a pair of opposed cover portions and wherein the spine portion is provided with a quick release self-adhering fastener for securing a folio assembly in position along the spine portion so that upon opening the covers of the case, the folio pages may be turned in the manner of turning the pages of a book.

In accordance with another important aspect of the present invention, there is provided an interchangeable folio assembly for a carrying case having a frame member including self-adhering fastener means which may be attached to a cooperating portion of a self-adhering fastener mounted within the case and wherein the folio assembly frame includes means for supporting one or more elongated rod members which in turn support flexible pages or folios. In the preferred embodiment of the present invention, the folio assembly frame includes a pair of spaced apart support portions adapted to receive opposite ends of a plurality of elongated elastically deflectable support rods for supporting the folios. The folio pages are preferably adapted to have a tubular sleeve portion formed along one longitudinal edge for receiving the support rods and whereby the folio pages may be pivotally supported by the frame and within the interior of the briefcase.

In accordance with another important aspect of the present invention, there is provided a folio carrying case together with a removable folio assembly wherein self-adhering quick release fastening means is provided of the hook and loop type comprising respective cooperating elongated fastener strips which are secured to the case and to a portion of the folio assembly, respectively, whereby interchangeable folio assemblies may be quickly mounted in or removed from the case as desired.

Those skilled in the art will further appreciate the abovenoted features of the present invention and will recognize additional advantages and superior features of the invention upon reading the detailed description which follows in conjunction with the drawings.

DERSCRIPTION OF THE PREFERRED EMBODIMENT

Figure 1:
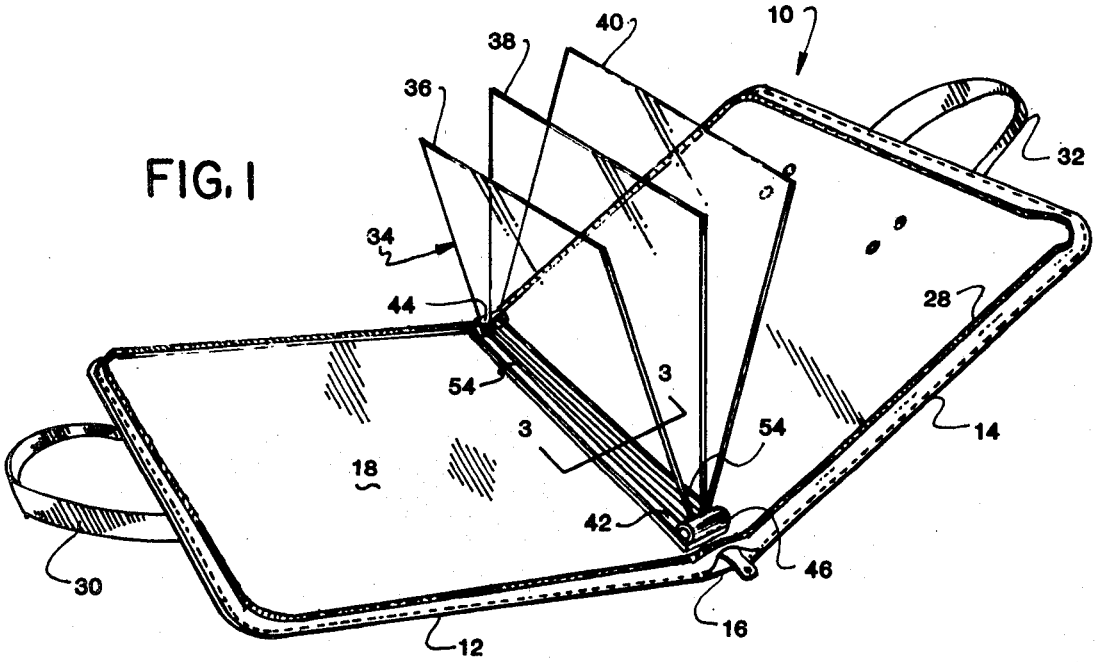
FIG. 1 is a perspective view of a portable carrying case in accordance with the present invention.

In the description which follows, like parts are marked throughout the specification and drawings with the same reference numerals, respectively. The drawings are not necessarily to scale, and certain details of the components may be exaggerated in scale to better illustrate the structure of the present invention.

Referring to FIG. 1, there is illustrated a portable folio carrying case, generally designated by the numeral 10. The case 10 may be considered a briefcase, attache case or, in particular, be given the designation folio case in accordance with the particular use thereof. For purposes of discussion herein, the term folio is used in a general sense to describe a generally rectangular member which may be flexible or substantially rigid and which is adapted to be attached along one edge to a support member whereby the folio member may be turned in the manner of turning the pages of a book. In the description which follows, a specific embodiment of a set of folios is described and illustrated which comprise substantially transparent plastic members which are formed to have pockets for receiving flat generally rectangular materials such as photographs, samples of art work, literature, etc.

Figure 3:
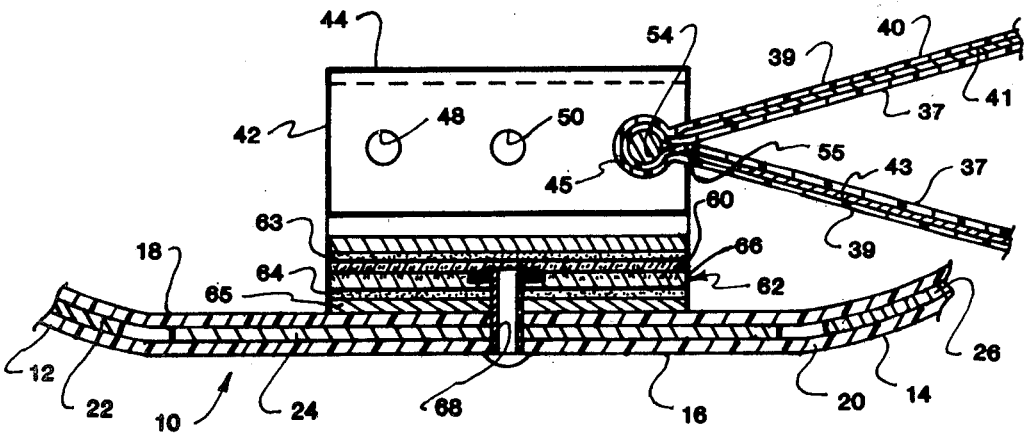
FIG. 3 is a section view taken substantially along the line 3—3 of FIG. 1.

The exemplary embodiment of the folio case 10 illustrated in the drawings includes two opposed cover portions designated by the numerals 12 and 14 which are hinged to an integral spine portion, generally designated by the numeral 16. The case 10 may be fabricated in a conventional manner and using conventional or known materials. For example, the case 10 may be formed to have a single piece flexible inner liner 18 typically made of a sheet of vinyl or the like. The structure comprising the cover portions 12 and 14 and the spine portion 16 also would include an outer fabric cover layer 20 also formed as a unitary piece of material. The construction of the case 10 may include a substantially rigid intermediate backing sandwiched between the liner 18 and the fabric cover 20 and comprising generallyrectangular flat members 22, 24, and 26, portions of which are shown in FIG. 3. The backing members 22, 24 and 26 may be formed of a suitable semi-rigid particle or cardboard material, for example. The case 10 would typically be assembled by sewing the backing members between the vinyl liner and the fabric outer layer and by providing a sewn in closure member such as a slide fastener 28. The case 10 is also provided with suitable flexible handle portions 30 and 32.

Referring still further to FIG. 1, the improved folio case 10 includes a removable folio assembly generally designated by the numeral 34. The folio assembly 34 includes a plurality of folio pages 36, 38 and 40, each of which may be multi-leaved or single leaved in accordance with the particular construction of the folio pages.

Figure 2:
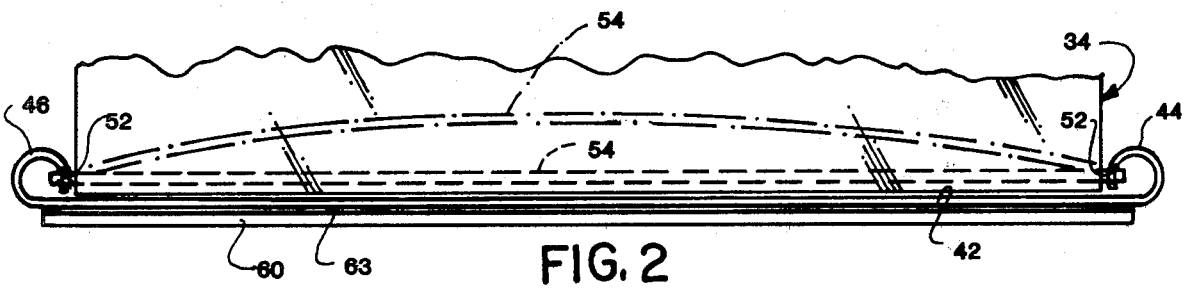
FIG. 2 is a longitudinal side elevation of a folio assembly for mounting in the carrying case illustraed in FIG. 1.

Referring also to FIG. 2, the folio assembly 34 comprises an elongated frame member 42, preferably comprising an elongated generally flat metal or plastic bar, having opposite end portions formed in a generally curved or coiled configuration as indicated by the numerals 44 and 46. The end portions 44 and 46 are each provided with a set of spaced apart holes as indicated by way of example for the end portion 44 as shown in FIG. 3. The folio pages 36 and 38 have been removed from the frame member 42 in FIG. 3 to show holes 48 and 50. A third set of holes 52 in the end portions 44 and 46 are shown supporting one of the rods 54 in FIGS. 2 and 3. The set of holes in the end portion are aligned generally with a similar set of holes in the end portion 46 whereby the end portions may support a plurality of elongated folio support members. The support members 54 are preferably characterized by elongated cylindrical rods which may be made of a substantially rigid but elastically deflectable material such as steel or plastic, for example, and which may be flexed or deflected out of a normal straight linear configuration as indicated for one of the rods 54 shown by the dashed lines in FIG. 2. Accordingly, the folio support rods 54 may be inserted into and removed from the frame 42 by deflecting the rods to insert them into or remove them from the holes in the respective end portions. Each of the folio support rods 54 is adapted to support a folio so that the folios may be placedadjacent to each other as in the closed pages of a book or may be separated and turned also in the manner of turning the pages of a book.

Referring to FIG. 3, a portion of the folio 40 is shown by way of example as comprising a generally transparent member comprising two layers 37 and 39 of transparent plastic material which may be suitably secured together along three edges to form a pocket for receiving substantially flat members 41 and 43 which may typically be photographs, pieces of art board, or any of several pieces of substantially flat material. The folio layer 37 is adhesively secured to itself at 55 to form an elongated tubular sleeve portion 45, FIG. 3, through which the support rod 54 may be removably inserted.

The folio assembly 34 is particularly adapted for rapid insertion in and removal from the case 10 by the provision of self-adhering quick release retaining or fastener means comprising cooperable elongated flat members, generally designated by the numerals 60 and 62, respectively. The fastener member 60 is preferably secured to one side of the frame member 42 by suitable adhesive such as a typical epoxy type adhesive 63. The fastener member 62 preferably includes a somewhat rigid plastic or metal backing member 65 and a fastener strip layer 66 suitably secured thereto by an adhesive layer 64, for example. The fastener member 62 may be secured to the spine portion 16 in any suitable manner such as by means of spaced apart metal or plastic rivets 68, one shown in FIG. 3. The fastener members 60 and 62 are preferably of the self-adhering tear apart hook and loop type such as the type of fastener sold under the trademark VELCRO.

Accordingly, those skilled in the art will appreciate that the folio assembly 34, including the frame member 42, may be quickly and easily placed in or removed from the case 10 by adhering the frame member 42 to the spine portion 16 by the fastener members 60 and 62. Moreover, if it is desired to remove the folio assembly 34 and replace it with a different folio assembly having the same basic structural features as the folio assembly 34, it is merely necessary to pull the frame member 42 away from the spine portion and replace it with thealternate folio assembly. Of course, the folio members 36, 38 and 40 may be individually interchanged or replaced by other folio members by removing the folio member and its associated support rod 54 from the frame member 42 in the manner described herein. Still further, the individual folio members 36, 38 or 40 may also be removed from their associated support rods 54 wherein the support rods may be inserted in other folio members and replaced in the frame 42.

Those skilled in the art will appreciate from the foregoing description that a particularly versatile folio case is provided in accordance with the present invention wherein an interchangeable folio assembly may be quickly and easily replaced by a.similar folio assembly within the case 10. Alternatively, the individual folio members may be removed from the folio assembly frame and replaced as needed. Although the hook and loop type fastener structure represented by the fastener members 60 and 62 is particularly advantageous for use in connection with the present invention, other quick release retaining means may be used for retaining the frame member 42 in assembly with the spine portion 16 of the folio carrying case. As indicated above, the folios 36, 38 and 40 may also comprise additonal folio pages by, for example, nesting additional folio members within each otherwithin the practical limit of the overall thickness of the folio and the ability to adhesively bond the additional layers of the folio material to each other.

Those skilled in the art will appreciate that various substitutions and modifications may be made to the folio carrying case and the folio assembly described herein without departing from the scope and spirit of the present invention as defined by the appended claims.

What I claim is:

1. A folio carrying case comprising:

a pair of opposed cover portions joined to a central spine portion, said cover portions each being hinged to said spine portion along opposite longitudinal sides of said spine portion;

a folio assembly adapted to be removably mounted in said case between said cover portions, said folio assembly including at least one folio, a plurality of elongated support members, each comprising a rod of elastically deflectable material secured to said folio along one edge of said folio;

a support frame member for releasably supporting said plurality of elongated support members in substantially side-by-side relation at opposite ends of said plurality of support members; and quick release retaining means comprising cooperating elastic hook and loop fastener members mounted on said spine portion and said frame member, respectively, whereby said at least one folio may be secured to said case and may be selectively removed from said case by removing the particular one of said plurality of support members associated with said at least one folio from said frame or by removing said at least one folio and said frame member in assembly from said case.

2. The folio case set forth in claim 1 wherein:

said frame member includes an elongated substantially flat member including means at opposite ends for supporting the opposite ends of said support members, respectively.

3. The folio case set forth in claim 1 wherein:

said pair of members comprising said fastener comprise a pair of Velcro type fastening members.

4. The folio case set forth in claim 1 wherein:

one of said fastener members is secured to said spine portion with rivet means.

5. The folio case set forth in claim 1 wherein:

one of said fastener members is secured to said frame member with an adhesive.

* * * * *